US007610952B2

(12) United States Patent
Reddy et al.

(10) Patent No.: US 7,610,952 B2
(45) Date of Patent: Nov. 3, 2009

(54) STEAM CONDENSER WITH TWO-PASS TUBE NEST LAYOUT

(75) Inventors: Konala Lakshmana Reddy, Vikasnagar (IN); Nagapatnam Sundararajan, Vikasnagar (IN); Guddanti Ramamohana Rao, Ramachandrapuram (IN); Vinod Kumar Saxena, Ranipur (IN)

(73) Assignee: Bharat Heavy Electricals Limited, Kolkata (IN)

( * ) Notice: Subject to any disclaimer, the term of this patent is extended or adjusted under 35 U.S.C. 154(b) by 299 days.

(21) Appl. No.: 11/791,624

(22) PCT Filed: Aug. 4, 2006

(86) PCT No.: PCT/IN2006/000278

§ 371 (c)(1),
(2), (4) Date: May 25, 2007

(87) PCT Pub. No.: WO2007/110873

PCT Pub. Date: Oct. 4, 2007

(65) Prior Publication Data

US 2009/0126912 A1 May 21, 2009

(30) Foreign Application Priority Data

Mar. 27, 2006 (IN) ..... 270/KOL/06

(51) Int. Cl.
*F28B 1/02* (2006.01)
*F28B 9/10* (2006.01)

(52) U.S. Cl. ..... 165/114; 165/113

(58) Field of Classification Search ..... 165/110–114
See application file for complete search history.

(56) References Cited

U.S. PATENT DOCUMENTS

| | | | | | |
|---|---|---|---|---|---|
| 1,382,676 | A | * | 6/1921 | Scanes | 165/114 |
| 1,662,186 | A | * | 3/1928 | Grace | 165/114 |
| 1,745,857 | A | * | 2/1930 | Lucke | 165/114 |
| 1,780,781 | A | * | 11/1930 | Ehrhart | 165/114 |
| 1,855,231 | A | * | 4/1932 | Grace | 165/114 |
| 2,201,783 | A | * | 5/1940 | McNulty | 165/114 |
| 2,830,797 | A | * | 4/1958 | Garland | 165/110 |
| 3,061,273 | A | * | 10/1962 | Dean, Jr. et al. | 165/114 |
| 3,795,273 | A | * | 3/1974 | Brigida et al. | 165/112 |
| 4,226,283 | A | | 10/1980 | Furukawa et al. | |
| 4,461,346 | A | * | 7/1984 | Hoshino et al. | 165/114 |
| 4,958,679 | A | * | 9/1990 | Drosdziok et al. | 165/288 |
| 5,205,352 | A | * | 4/1993 | Takahashi et al. | 165/113 |
| 5,649,590 | A | | 7/1997 | Andrieux et al. | |
| 5,960,867 | A | * | 10/1999 | Takahashi et al. | 165/114 |
| 6,041,852 | A | * | 3/2000 | Sato et al. | 165/114 |
| 6,269,867 | B1 | | 8/2001 | Takahashi et al. | |
| 2001/0025703 | A1 | | 10/2001 | Blangetti et al. | |
| 2005/0109032 | A1 | | 5/2005 | Harpster | |

* cited by examiner

*Primary Examiner*—Allen J Flanigan
(74) *Attorney, Agent, or Firm*—The Webb Law Firm

(57) ABSTRACT

A compact two-pass steam condenser with at least one improved tube nest configuration, having, a steam inlet through which steam is received; at least one tube nest in two distinct bundles, the top and the bottom bundle each have a plurality of cooling tubes arranged in two distinct bundles and separated by a pass-partition for condensing the steam received through the steam inlet; and at least one non-condensable gas extracting tube through which non-condensable gas contained in the steam is extracted; a condensate outlet through which condensate condensed by the cooling tubes is discharged; and a vessel surrounding the tube nest.

6 Claims, 5 Drawing Sheets

STEAM CONDENSER WITH TWO-PASS TUBE NEST LAYOUT

FIELD OF THE INVENTION

Figure 1:
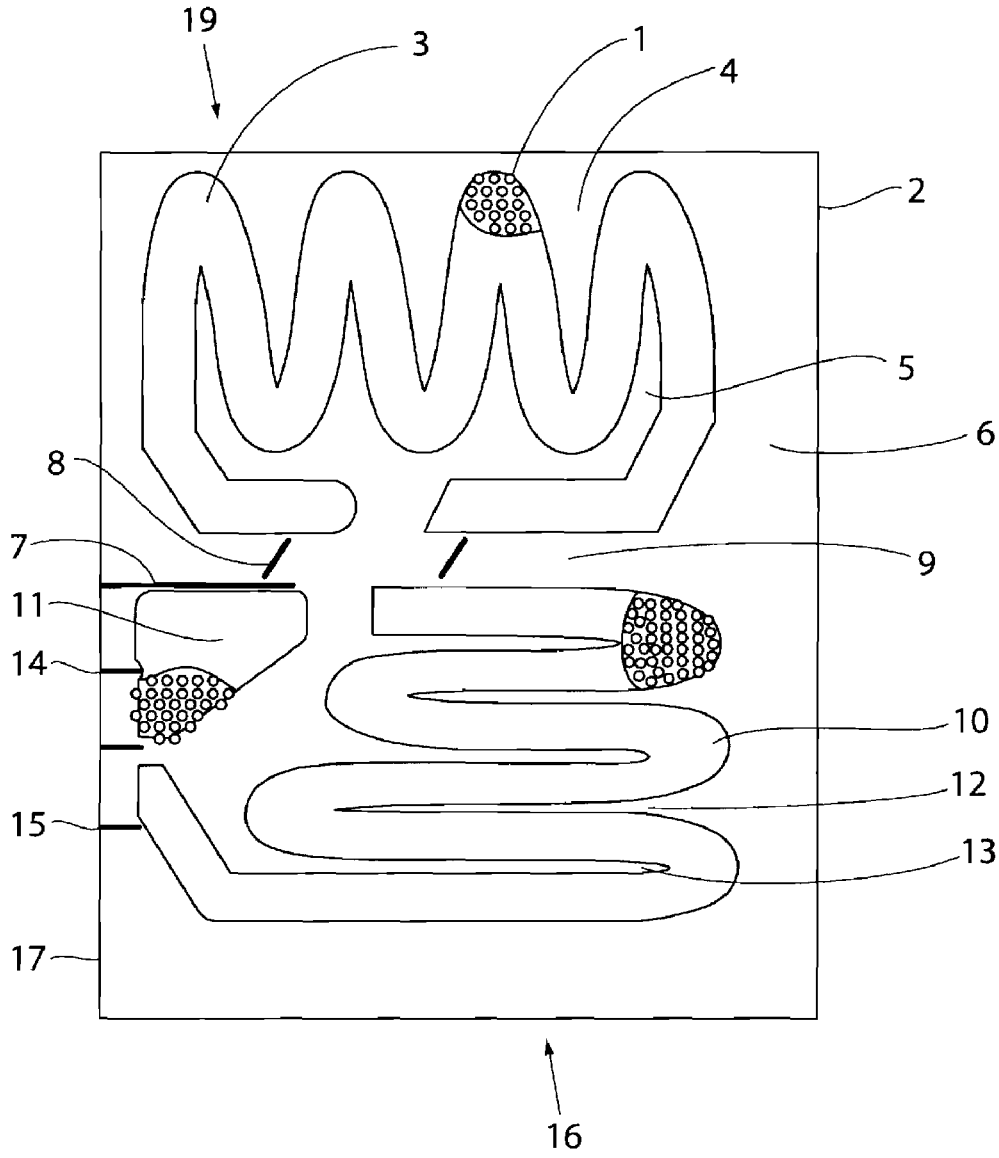

The invention relates to a steam condenser for condensing steam in a power plant or in a chemical plant application. The present invention, in particular allows optimization of tube arrangement of both first pass and second pass sections with a well-defined connectivity between them. More particularly, the present invention relates to a compact two-pass steam condenser having at least one improved tube nest configuration for reducing loss of steam pressure.

BACKGROUND OF THE INVENTION

A steam-condenser consists of a large number of tubes configured in a nest shape. The number of tubes can be as high as 30,000 in a large power plant condenser. Thermal performance of a condenser is highly dependent on the arrangement of these tubes. This tube nest arrangement shall be capable of reducing the loss of steam side pressure and of removing efficiently the non-condensable gas in the steam. Two-pass condensers are generally used to limit the condenser length. Thermal hydraulics are more complex in a two-pass condenser as approximately two-thirds of total steam condenses on the tubes in the first pass wherein the temperate of the coolant passing through the tubes is comparatively low and the rest of the steam condenses on the tubes in the second pass. U.S. Pat. No. 5,649,590 describes a tube layout in the form of radiating spikes. Some of the spikes split into branches. The branching spikes comprise a base trunk which flares and splits into two branches of equal thickness as soon as the thickness of the trunk of the spike reached between one-and-a-half and two times the thickness of its base. This form of layout makes it possible to install a greater number of tubes in a given area of the tube plate.

Another version of tube nest layout has been disclosed in U.S. Pat. No. 5,960,867. The tube nest is spaced from the bottom surface and the side walls of the vessel so that steam is able to flow from every direction into the tube nest at a reduced velocity. The extracting opening is disposed between the centre of gravity of the outer circumference and the width of each flow passage increases toward the open outer end. The area ratio and the length of flow passage increase toward the center axis of the tube nest. The advantage claimed is a compact condenser capable of reducing pressure loss and efficiently removing non-condensable gas.

U.S. Pat. No. 6,269,867B1 describes a tube nest which has a massed region of cooling tubes and a plurality of tube bundles with flow passages. A non-condensable gas extracting tube is arranged in the massed region. A discharge flow passage if formed at least partially in the tube nest to enable non-condensable gases from the cooling unit or the steam condensing chamber to be discharged outside of the condenser whereby condensing efficiency of the steam contained in the non-condensable gases which flow into the cooling unit or the steam condensing chamber is improved.

A condenser tube nest layout based on church window principle is described in U.S. patent Application publication No. US 2001/0025703A1. The condenser consists of at least one bundle with multiplicity of tubes arranged parallel to one another, the bundle sub-divided into an upper sector and lower sector. A condensate discharge element is arranged in the bundle between the upper sector and the lower sector. This arrangement helps in preventing excessive blockage of steam paths due to condensate raining down.

However, all the prior art tube nest configurations are evolved mainly for single pass steam condensers and these configurations cannot be optimally used for two-pass condensers. Although U.S. Pat. No. 5,649,590 adapts branching spikes concept, the condenser has the disadvantage of possible air pockets formation in spikes as steam enters from both sides of the spike.

The tube nest of U.S. Pat. No. 5,960,967, in which a plurality of flow passages extend from outer circumference towards the extracting opening, suffers from lack of vent lanes.

The tube nest developed based on church window concept and as disclosed in US 2001/0025703, has thick bundle width which results in higher steam side pressure drop.

In a two pass condenser, the available average temperature potential between steam and cooling water is drastically different between the tubes in the first pass and in the second pass. Due to this phenomenon, steam condensation in the first pass is nearly 66% and that in the second pass is 34%. None of the above prior art has considered this phenomenon and hence they are basically applicable to single pass condenser

OBJECTS OF THE INVENTION

It is, therefore an object of this invention to propose a compact two pass steam condenser having at least one improved tube-nest configuration for reducing loss of steam pressure by allowing uniform steam distribution around the tube nest including better accessibility of steam to all the tubes.

Another object of the invention is to propose a compact two pass steam condenser having at least one improved tube-nest configuration for reducing loss of steam pressure which eliminates the disadvantages of prior art devices.

Yet another object of this invention is to propose a compact two pass steam condenser having at least one improved tube-nest configuration for reducing loss of steam pressure which provides proper venting of non-condensables including effective discharge of the non-condensables through an air cooling section.

A further object of the invention is to propose a compact two pass steam condenser having at least one improved tube-nest configuration for reducing loss of steam pressure which promotes better deaeration of condensate A Still further object of the invention is to propose a compact two pass steam condenser having at least one improved tube-nest configuration for reducing loss of steam pressure in which the tube sheet area is optimally utilized.

SUMMARY OF THE INVENTION

With the foregoing objects in view, the present invention provides a compact condenser which comprises, a steam inlet through which steam is received, a plurality of cooling tubes for condensing the steam received through the steam inlet, a condensate outlet through which condensate produced by the cooling tubes is discharged, and at least one extracting means through which non-condensable gases contained in the steam are extracted.

BRIEF DESCRIPTION OF THE ACCOMPANYING DRAWINGS

FIG. 1—Shows a schematic diagram depicting a compact steam condenser, indicating configuration of the cooling tubes on a tube plate, according to the present invention.

Figure 2:
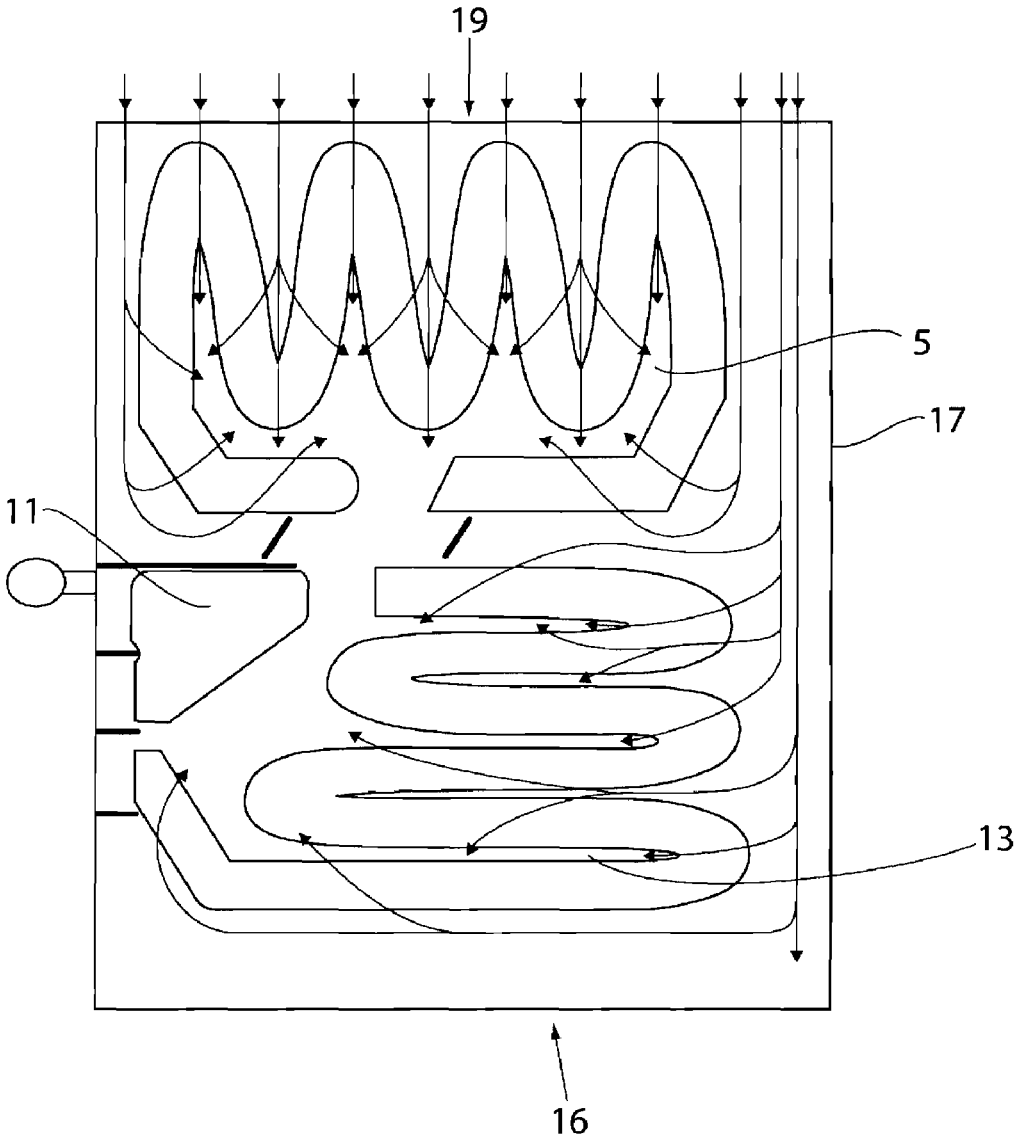

FIG. 2—Shows the streamlines of steam flow in a condenser in accordance with the invention.

Figure 3:
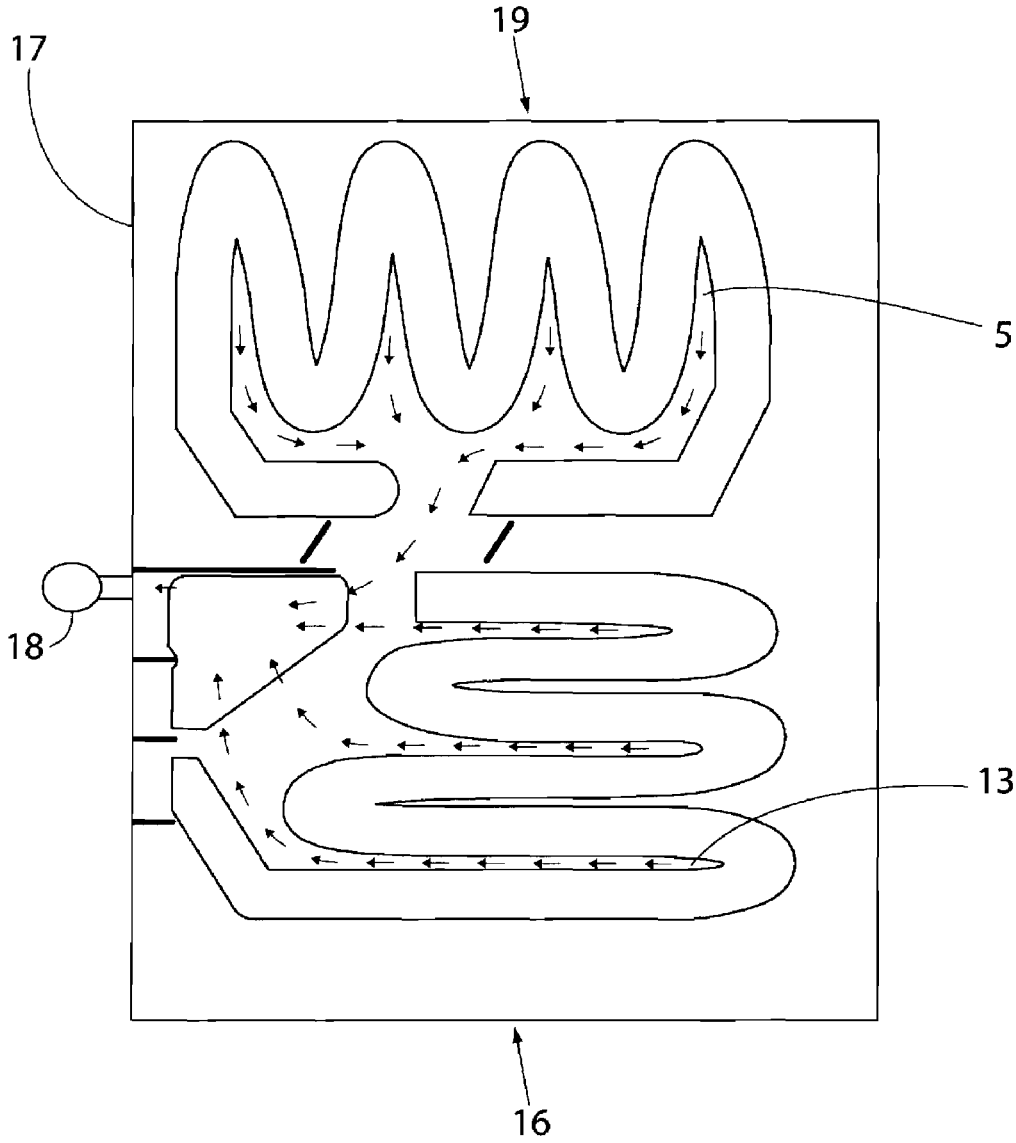

FIG. 3—Shows the flow of steam with high concentration of non-condensables according to the invention.

Figure 4:
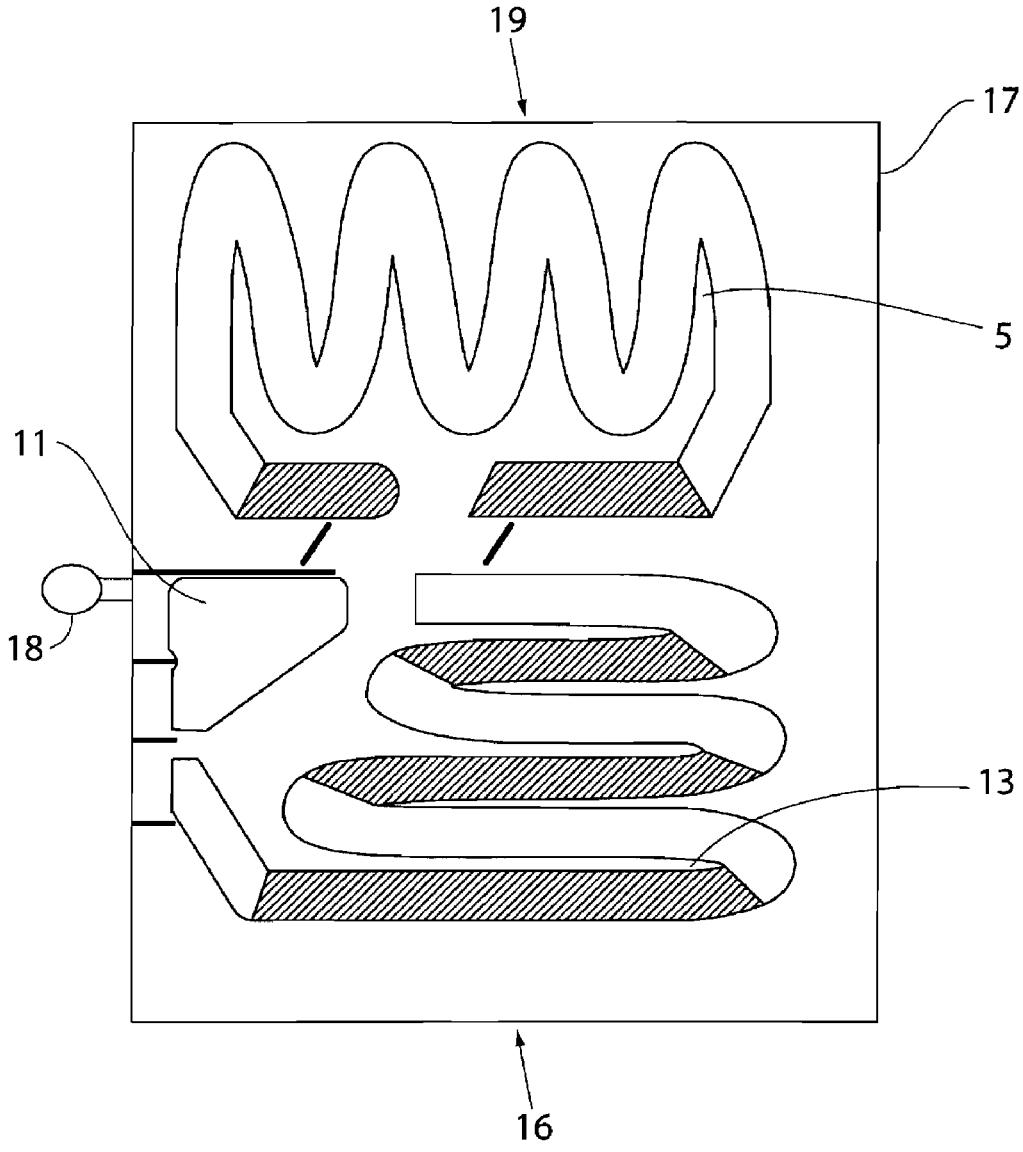

FIG. 4—Shows a horizontal segments of the tube nest in a compact condenser according to the invention.

Figure 5:
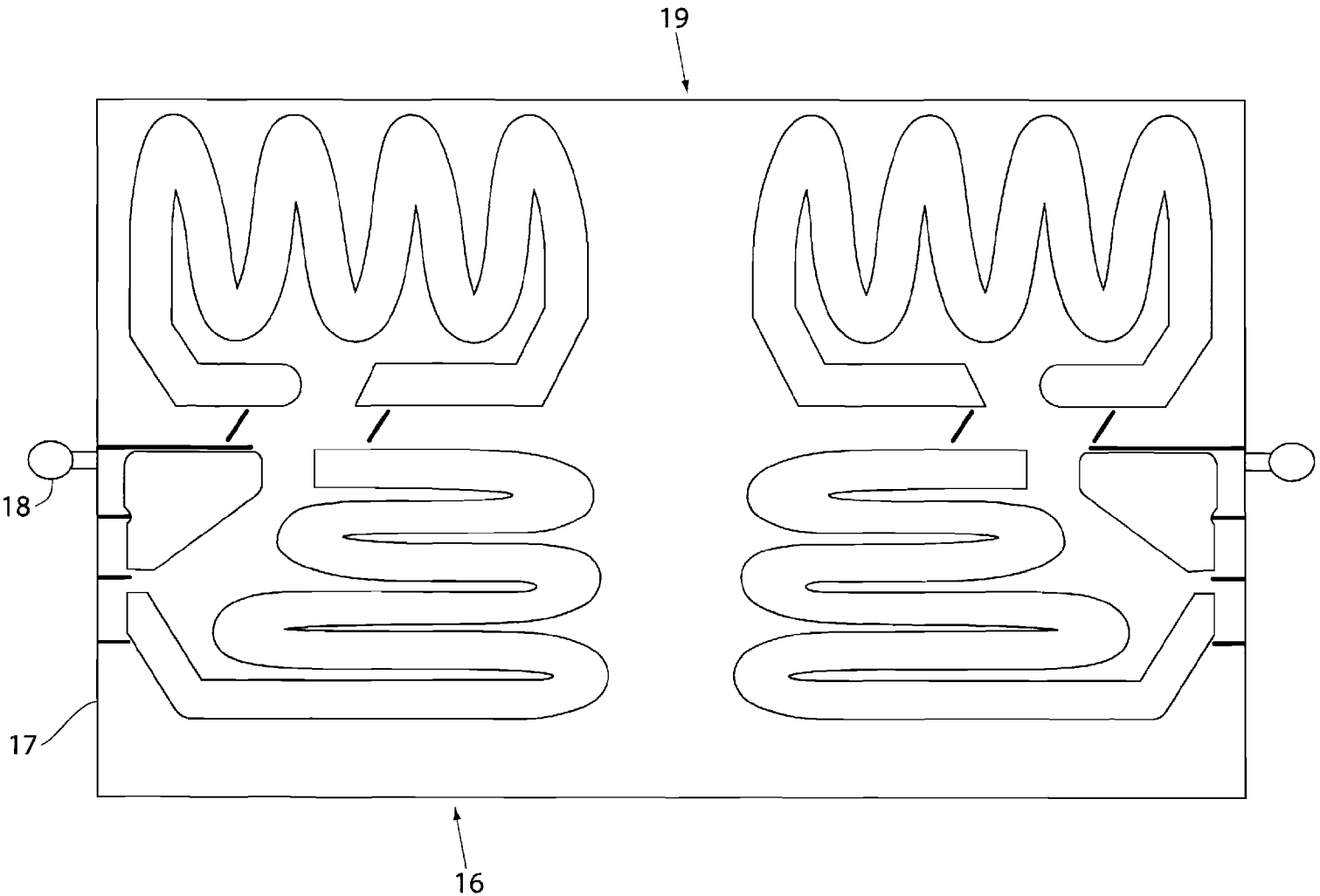

FIG. 5—Shows a condensate outlet (hot-well)

DETAILED DESCRIPTION OF A PREFERRED EMBODIMENT OF THE INVENTION

As shown in FIG. 1, a plurality of cooling tubes (1) is arranged on a tube plate (2) in two bundles, a top bundle (3) which represents a second pass with relatively higher temperature of cooling water flowing trough the tubes (1) of the condenser, accommodates 50% of total number of the tubes (1) of the tube nest, and the remaining tubes (1) are arranged in a bottom bundle (10) which represents a first pass (10) with relatively lower temperature of cooling water flow through the tubes (1) of the condenser. A pass partition (9) separates the first (10) and the second passes (3). An air cooling zone (11) is located in the first pass (10). At least two steam lanes (4, 12) are provided, the width of the at least two steam lanes (4,12) in the second and first passes (10,3) decrease gradually as steam flows into the tubed region of the nest. A contour of the steam lanes is such that uniform velocity is maintained in the steam lanes (4,12). The widths of the steam lanes (4,12)) are selected based on the steam quantity so as to maintain comparable velocities in the steam lanes (4,12) of the first and second passes (10,3). Steam enters the first pass (10) through a central lane (6). A plurality of Vent lanes (5 & 13) are provided in the first and second passes (10,3) which guide the steam with high concentration of non-condensables to the air cooling zone (11). A first baffle plate (7) provided to prevent direct steam entry to the air cooling zone (11) from the top. A plurality of second baffle plate (8) disposed in the pass partition (9) to prevent the steam having direct access through the pass partition (9) to the air cooling zone (11). A plurality of third baffle plates (14) provided to direct the non-condensables into the tubed regions of an air-cooler and restrict a bypassing of the non-condensables directly to a suction pump (18). A fourth baffle plate (15) restricts the passage of the steam from the bottom of the tube nest (1) to the air cooling zone (11).

Streamlines of steam flow are shown in FIG. 2. The nest configuration allows uniform steam distribution around the tube nest (3,10) and provides an improved accessibility of steam to all the tubes (1) and thus the steam pressure loss is minimised. The number of rows of the tubes (1) crossed by steam is also selected based on steam quantity entering the bundles (3,10). As the steam quantity to the first pass (10) is approximately 66% of total steam, the number of tubes (1) crossed in the first pass (10) are selected less compared to the number of tubes (1) in the second pass (3). Thus pressure balance including low steam pressure loss are achieved by the invention. A vessel (17) surrounds the tube nest (3,10).

FIG. 3 shows the flow of steam with high concentration of non-condensables. Steam enters through inlet (19) and as it passes through tubes (1), steam gets condensed and concentration of non-condensables increases. By provision of the plurality of vent lanes (5,13), the steam with high concentration of non-condensables from all parts of the nest are directed towards the air cooling zone (11). The air cooling zone (11) is located in the first pass (10) as the cooling of the non-condensables and the condensation of steam in the non-condensable mixture are more effective in the first pass (10). A condensate outlet (16) is provided via which condensate condensed by the cooling tube is discharged. The converging configuration of the air cooling zone (11) towards the exit provides better connective heat transfer and aids improved cooling of non-condensable mixture. Proper cooling of the non-condensables helps in reduction in their volume flow and ensures effective discharge by a suction pump (18) or an ejector connected to the exit of the air cooling zone (11).

The present invention has features, which promote better deaeration in the steam condenser. A plurality of the tubes (1) of said tube nest, is configured as horizontal segments as indicated in FIG. 4 have counter flow steam path with respect to the condensate flow. This feature helps in condensate heating and consequent liberation of dissolved oxygen from the condensate. The direct impingement of live steam on hot-well surface through the central steam lane (6) helps in promoting better deaeration. The positive discharge of non-condensables through the vent lanes (5,13) as described above contributes in improving deaeration of steam.

One tube nest can be used in a single section condenser and two tube nests as mirror images to each other, as shown in FIG. 5 can be wised in a double section condenser.

A typical power plant condenser with the present invention gives an improvement of 15% in heat flux compared to conventional designs due to reduced steam pressure loss and improved venting system. This leads to a reduction in exhaust pressure of turbine and consequent improvement in power generation. Alternatively, for the same exhaust pressure of steam turbine, the number of cooling tribes can be reduced with the present invention and achieve savings in material cost.

We claim:

1. A compact two-pass steam condenser having at least one improved tube nest configuration, comprising, a steam inlet through which steam is received; at least one tube nest in two distinct bundles, the top and the bottom bundle each having a plurality of cooling tubes for condensing the steam received through the steam inlet; and at least one non-condensable gas extracting tube through which non-condensable gas contained in the steam is extracted; a condensate outlet through which condensate condensed by the cooling tubes is discharged; and a vessel surrounding the tube nest, wherein the cooling tubes arranged in two distinct bundles and are separated by a pass-partition to form converging flow passages for the steam; the top bundle having vertical flow passages and the bottom bundle horizontal flow passages;

wherein the top bundle receives steam directly from the inlet and the bottom bundle, in the case of a double section, receives steam from the inlet through a central zone, and through a passage between the vessel and the at least one tube nest in case of single section type of condenser; and wherein 5 to 10% of the cooling tubes are arranged in a distinct zone in the bottom bundle to form air cooling zone for cooling the non-condensable gases from a main cooling unit.

2. The condenser as claimed in claim 1, wherein the steam with high concentration of non-condensate gases is guided by the diverging passages created in the tube nest from different zones of the cooling unit to the air cooling zone, the air cooling zone converging in the steam flow direction so as to achieve an effective cooling of the non-condensable gases.

3. The condenser as claimed in claim 1, wherein a plurality of baffle plates provided between the side walls of the vessel and the air-cooling zone to prevent by-passing of non-condensable gases directly towards a suction pump.

4. The condenser as claimed in claim 1, wherein the pass-partition is adapted as a steam lane.

5. The condenser as claimed in claim 1, wherein the steam by-passing to air cooling zone is restricted by providing a plurality of baffles at selected locations.

6. The condenser as claimed in claim 1, wherein a plurality of the tubes configured as horizontal segments to provide better interaction of steam and condensate due to counter flow conditions prevailing in the tube nest thereby promoting effective deaeration of condensate.

* * * * *